United States Patent [19]

Little, Jr. et al.

[11] Patent Number: 4,536,152

[45] Date of Patent: Aug. 20, 1985

[54] HIGH-VELOCITY GAS BURNERS

[75] Inventors: Victor Little, Jr., Edison; Charles L. Thomas, South Plainfield, both of N.J.

[73] Assignee: ASARCO Incorporated, New York, N.Y.

[21] Appl. No.: 598,397

[22] Filed: Apr. 10, 1984

Related U.S. Application Data

[63] Continuation-in-part of Ser. No. 482,080, Apr. 4, 1983, abandoned.

[51] Int. Cl.[3] ..... F23D 13/00

[52] U.S. Cl. ..... 431/159; 431/181; 431/347

[58] Field of Search ..... 431/159, 347, 353, 181, 431/187, 188

[56] References Cited

U.S. PATENT DOCUMENTS

| | | | |
|---|---|---|---|
| 2,515,845 | 7/1950 | van den Bussche | 431/353 |
| 2,670,788 | 3/1954 | MacFarlane | 431/353 X |
| 2,790,838 | 4/1957 | Schrader | 431/158 X |
| 2,839,128 | 6/1958 | Schweitzer et al. | 431/353 X |
| 2,849,860 | 9/1958 | Lowe | 126/144 X |
| 3,199,977 | 8/1965 | Phillips et al. | 266/188 X |
| 3,299,940 | 1/1967 | Phillips et al. | 431/347 X |
| 3,384,442 | 5/1968 | Stewart et al. | 431/347 X |
| 3,701,517 | 10/1972 | Gray | 266/188 X |
| 3,715,203 | 2/1973 | De Bie | 75/76 |
| 3,788,623 | 1/1974 | Vogel | 266/900 X |
| 3,956,531 | 5/1976 | Church et al. | 427/226 |
| 4,120,639 | 10/1978 | Thekdi et al. | 431/181 X |
| 4,156,590 | 5/1979 | Pariani | 431/158 X |
| 4,211,555 | 7/1980 | Berry et al. | 75/72 |
| 4,295,821 | 10/1981 | Schilling | 431/264 X |
| 4,301,997 | 11/1981 | Berry et al. | 266/236 |
| 4,309,170 | 1/1982 | Ward | 432/96 |
| 4,311,519 | 1/1982 | Berry | 266/236 X |
| 4,318,688 | 3/1982 | Buschulte et al. | 431/265 X |
| 4,364,725 | 12/1982 | Buschulte | 431/265 X |
| 4,475,885 | 10/1984 | Finke | 431/188 X |

FOREIGN PATENT DOCUMENTS

| | | | |
|---|---|---|---|
| 1100029 | 4/1981 | Canada | 266/188 |
| 611318 | 3/1935 | Fed. Rep. of Germany | 431/181 |
| 2946120 | 5/1981 | Fed. Rep. of Germany | 266/188 |

*Primary Examiner*—Samuel Scott
*Assistant Examiner*—Kenichi Okuno
*Attorney, Agent, or Firm*—John J. Tomaszewski; Kenneth A. Koch

[57] ABSTRACT

High-velocity gas burners having enhanced flame stability over wide operating ranges are provided by correlating the dimensions of the combustion chamber with other burner dimensions, in particular, the ratio of the combustion chamber diameter to the flame holder exit diameter and the ratio of the effective length of the combustion chamber to the combustion chamber diameter.

10 Claims, 4 Drawing Figures

HIGH-VELOCITY GAS BURNERS

CROSS-REFERENCE AND RELATED APPLICATIONS

This application is a continuation-in-part of application Ser. No. 482,080, filed Apr. 4, 1983, now abandoned.

BACKGROUND OF THE INVENTION

This invention relates to high-velocity gas burners having enhanced flame stability. More particularly, the invention relates to high-velocity gas burners having enhanced flame stability over wide operating ranges and are utilizable in melting furnaces and the like.

The need for burners providing efficient heating and melting is a very important industrial concern, especially today when energy costs are rising and supplies of fuel are decreasing. Along with this is the need for the burners to be adaptable for use in furnaces at both low and high tonnage operating conditions while maintaining the production of commercially acceptable molten metal products, i.e., free of contamination.

Gas burners of the type provided by the present invention may be used in several different furnaces or units where a high heat level is required. The present gas burners have been found to be effective in melting furnaces such as the upright melting furnace described and illustrated in U.S. Pat. No. 3,199,977 issued to Albert J. Phillips et al. on Aug. 10, 1965. In that patent, the gas burners are inserted into each of the side wall ports and held in position therein by bolts which hold the mounting plating of each burner body tightly against the shell of the furnace so as to provide a substantially gas tight mounting. This patent as well as other related patents does not suggest any means for enhancing the flame stability of the burner installed in a furnace or other highlevel heating unit. See, for example, U.S. Pat. No. 3,701,517; 3,715,203; 3,788,623; as well as the additional prior art cited within the reference. Several gas burner designs are disclosed in these references, and other burner combustion chamber systems have been discussed in U.S. Pat. Nos. 3,299,940; 4,211,555; 4,301,997; 4,309,170; and 4,311,519, Canadian Pat. No. 1,100,029 and DE Offenlegungsschrift No. 29 46 120.

A difficult problem in the burner art, especially with regard to their use in furnaces such as the Phillips et al. upright melting furnace, has been to provide a stable flame over wide operating conditions. In a burner of the configuration of the present invention, the flame will burn both inside and outside of the combustion chamber and its shape in the chamber is defined by the shape of the chamber, with its shape outside the chamber being generally conical. The burners typically have an igniter bar in the ignition section with the combustion chamber having a wider diameter than the outlet of the igniter section. The flame is held immediately downstream of the igniter bar and spreads to the unburned mixture passing by. Additional flame-holding is obtained with the annular area provided by the shoulder at the juncture of the igniter section and combustion chamber. Thus, two flame fronts are established, one spreading out from the igniter bar and the other spreading from the annular shoulder type flame-holder.

Unfortunately, however, the flame spreading from the annular shoulder may be unstable in that it does not completely form on the shoulder and, consequently, forms a black or cold spot at that area on the shoulder.

This type flame produces an unstable flame which will waiver and flutter, as well as, in the case of a vertical furnace for melting copper, causes a cold spot at that area on the shoulder at which metallic copper may deposit. This deposition of copper in the combustion chamber and/or unstable flame adversely affects the operation of the furnace causing impurities in the melted copper and possible shutdown of the furnace for cleaning. The flame unstability is particularly severe at the start-up of the burner when the furnace and burner are cold, but is also undesirably present at "steady-state" operation.

This problem has been particularly severe in the shaft furnace art when it is desired to design a furnace, e.g., one having a modest capacity, i.e., less than about 20 short tons per hour (STPH), that can be turned down over a 2.5 to 1 ratio while maintaining a stable flame in the burner. As used herein, "turndown" means the reduction of the melting rate of the furnace by decreasing the amount of fuel-oxygen mixture supplied to the burners. A turndown ratio of 2.5 to 1 for a furnace having a maximum design capacity of 20 STPH would bring the output as low as about 8 STPH, i.e., $20/2.5=8$. To properly run the furnace over such a wide operating range requires the burner to maintain a stable flame over the turndown range. If the flame is unstable at the low operating rate, the melted copper will become contaminated, metal will deposit in the combustion chamber, and other problems will occur.

For example, furnaces of low capacity have traditionally operated with but a single row of circumferentially spaced burners, since a second row has been thought would furnish more molten capacity than necessary, thus causing problems in turning the furnace melting rate down to lower rates without avoiding metal "slumping" and freezing within the furnace. In small furnaces the problem of obtaining a uniform distribution of heat from a single row of burners has been a severe problem. In these one row furnaces, at maximum heating rates, the metal easily can become suspended above the burner row, causing metal hang up problems when the nonmolten charge fails to descend from the large upper diameter section into the reduced lower diameter section of the furnace. Such a phenomenon results in high oxygen levels in the metal, uneven temperatures, and furnace "screaming". Additionally, the phenomenon of "voiding", which is an absence of furnace charged metal at the furnace base, also occurs as a result of this uneven heat distribution, and leads to overheated refractories, wide variations in molten metal temperatures, and large fluctuations in metal flow therefrom when operated at or near maximum heat input. In two row furnaces, and even one row furnaces, reduced turndown over long time periods can lead to the metal becoming "soft" as the supply of fuel diminishes and, hence, heat input is reduced, leading to eventual metal slumping within the furnace.

It is an object of the invention to provide a high velocity gas burner which has enhanced flame stability over a wide operating range. Other objects will be apparent from the following description.

SUMMARY OF THE INVENTION

This invention is particularly directed to an improved furnace gas burner comprising inlets adapted for supplying an effective stream of oxygen containing gas (air) and for supplying an effective stream of fuel to the burner, a mixing section for uniting the streams of oxygen containing gas and fuel, a flame holder section for igniting the mixture, and a substantially cylindrically shaped combustion chamber to retain the combustion and to enhance combustion, the improvement comprising: correlating the dimensions of the combustion chamber with other burner dimensions to provide a burner having about a $2\frac{1}{2}$:1 turndown capacity while maintaining a stable flame with even and complete combustion over this range, increased burner tile life, minimal molten metal contamination caused by "cold" spots in the combustion chamber, among other benefits.

The combustion chamber is substantially cylindrical and possesses an overall burner tile length, $L_T$, an "effective length", $L_E$, i.e., the length of the tile lining as measured from the intersection of the combustion chamber with the flame holder section (the "shoulder") to the opposite end of the chamber, and, a diameter, $D_S$, which is substantially constant throughout the chamber. The chamber is comprised of an outer refractory tile housing having openings, preferably substantially circular, at each end for the entrance ($D_F$) and exit ($D_S$) of the combustion gases and is usually fabricated from a suitable high temperature resistant refractory substance, most preferably SiC. The combustion chamber is further adapted to substantially combust the entering fuel and oxygen containing gases within, while continually maintaining a substantially even temperature gradient of predetermined temperature, preferably about 2800° F., along the effective length of the chamber. Such performance is obtained by designing the chamber in accordance with several important relationships: (1) The ratio of the combustionchamber diameter, $D_S$, to the diameter at the exit from the adjacent flame holder section, $D_F$, is between about 1.35 to 1.70, most preferably, about 1.43; and (2) The ratio of the effective length $L_E$, to the diameter $D_S$ of the combustion chamber is between about 1.2 to about 3.70, and preferably about 1.56 or 3.00. In a preferred embodiment, the burner assembly design will control the ratio of the overall length of the combustion chamber tile, $L_T$, to the "effective length" $L_E$ of the chamber, i.e., the length of the chamber tile lining as measured from the intersection with the flame holder section to the end of the chamber exit to be between about 1.20 to about 2.00, and preferably about 1.47.

While the burners are described as having a mixing section 50, it will be understood by those skilled in the art that the fuel and air may be mixed outside of the burner and transferred through the igniting section or flame holder section 51 into the combustion chamber 52. The present burners with this arrangement would function in the same manner, i.e., to provide a stable flame over a wide operating range.

The burner of this invention is particularly applicable for use in a low capacity vertical shaft furnace, i.e., a furnace producing less than about 20 STPH of metal, i.e., copper, which is comprised of a refractory lined brick chamber of substantially cylindrical shape, having a plurality of circumferentially spaced burners located in a spaced relationship about the lower extremities of the furnace, each burner adapted to supply a sufficient amount of energy, usually about 0.7 to about $1.8\times10^6$ BTU/hr. These furnaces are designed to supply an effective distribution of heat to evenly melt the descending solid charge, i.e., preferably copper cathodes and scrap, without causing furnace clogging and metal freezing. Larger burners may suitably be employed for higher capacity furnaces.

Other burners providing flame stability over wide operating ranges are provided by this invention for energy levels up to $50\times10^6$ BTU/hr, or higher, preferably in the range of about $2\times10^5$ to about $20\times10^6$, e.g., $30\times10^6$ BTU/hr. A preferred range is 0.7 to $10\times10^6$ BTU/hr, or $5\times10^6$ BTU/hr.

DETAILED DESCRIPTION OF INVENTION

Figure 1:
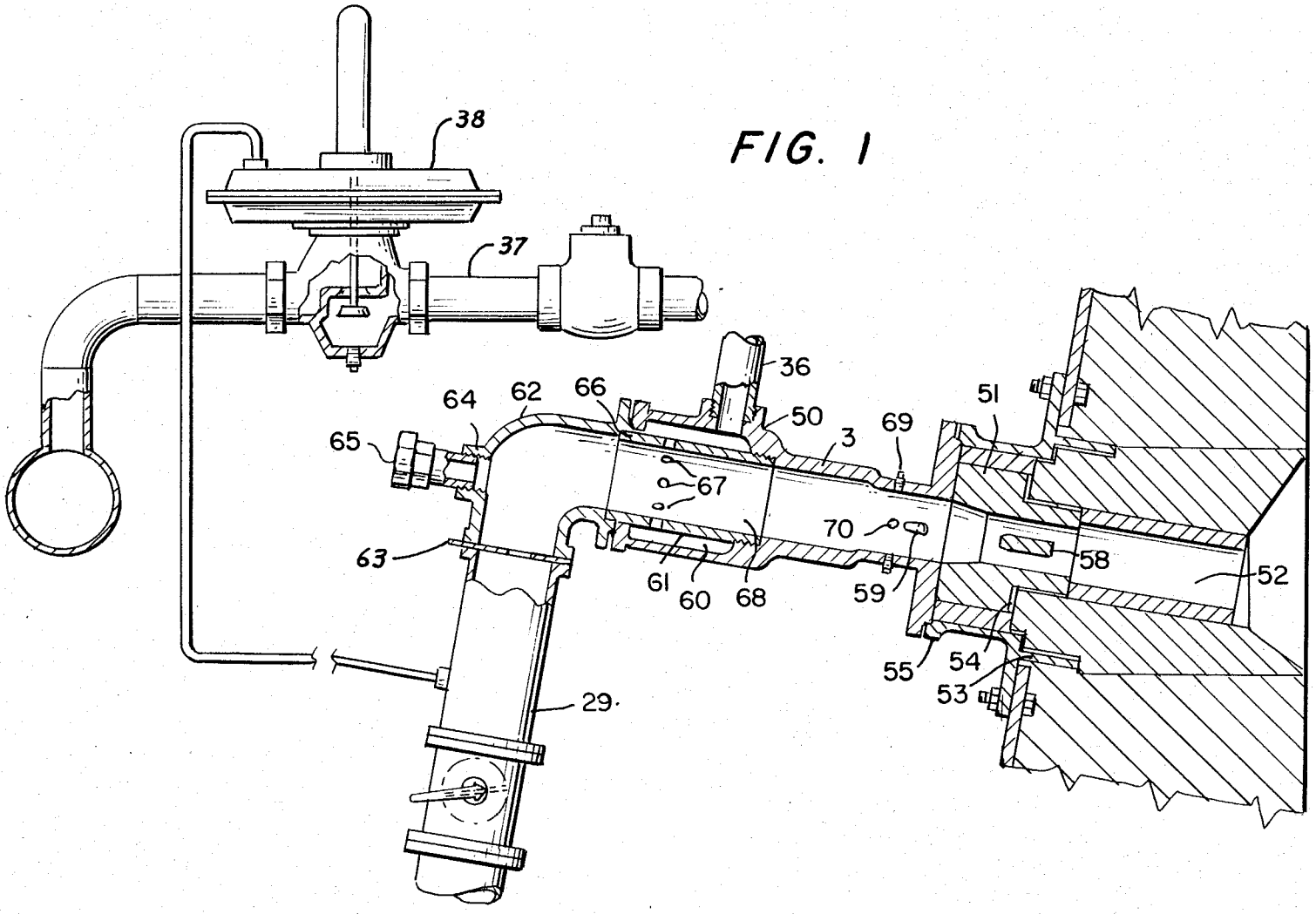
FIG. 1 is an enlarged vertical section view describing the burner assembly.

As can be seen in FIG. 1, burner body 3 is comprised of a mixing section 50 for uniting a stream of fuel and a stream of an oxygen-containing gas (air) to form a unit stream and for introducing the unit stream into flame holder section 51. The burner body is also provided with a combustion chamber section 52, which is more elaborately illustrated in FIG. 2, and is mounted on flange 53 against shoulder 54 of flame holder section 51. Igniter bar 58 may be disposed in the throat, and a conventional electrically activated spark plug 59 for igniting the unit stream is mounted on the side of section 51 with the inner end of the spark plug disposed adjacent bar 58. The combination of the throat and bar 58 are especially useful in maintaining combustion of the unit stream in combustion chamber 52, particularly at high fuel velocities. Section 51 is also provided with openings 69 and 70 for taking samples of the unit stream.

Section 50 has an annular manifold portion 60, sleeve 61, bend or elbow portion 62, orifice plate 63 and observation port 64 provided with transparent eye piece 65. Sleeve 61, which abuts shoulder 66 and the left end of section 50, cooperates with annular portion 60 to provide a manifold for introducing the smaller of the two streams to be united (usually the fuel stream) from pipe 36 through openings 67 into uniting chamber 68; the size and distribution of openings 67 about the periphery of the sleeve being selected to control entry to the fluid into the chamber. The larger stream is introduced to chamber 68 from pipe 29 through the orifice in plate 63 and bend portion 62.

In operating the burner body, the larger stream of the two streams to be united is conducted to the burner body through an orifice into a bend leading to the uniting chamber, and the precise composition of the stream is determined in the manner disclosed in U.S. Pat. No. 3,199,977.

Figure 2:
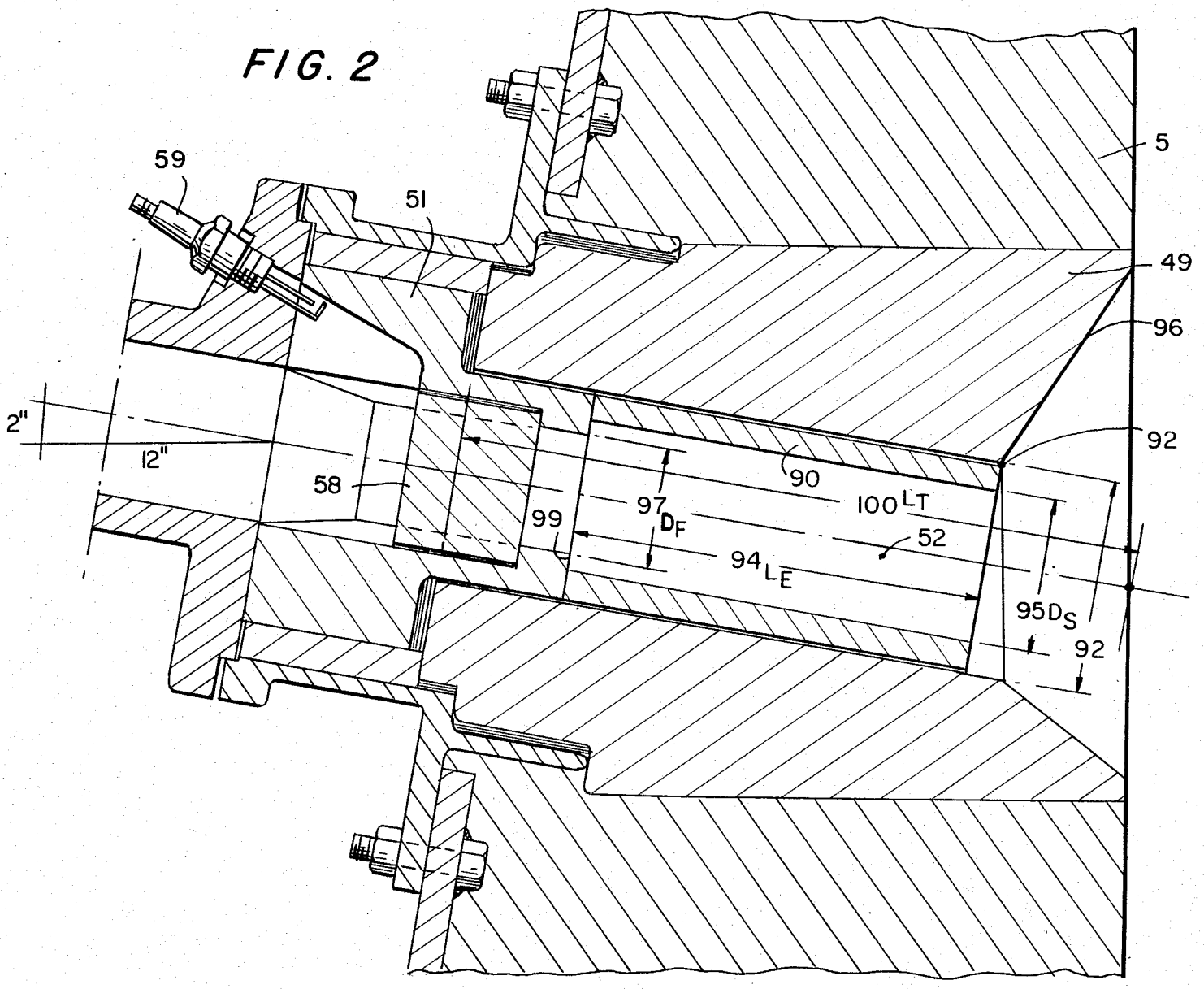
FIG. 2 is a section of the combustion chamber preferred for use in the invention.

FIG. 2 illustrates in detail the preferred structure of burner combustion chamber 52 when affixed in place in the refractory furnace wall 5. The gaseous fuel and air unit stream passes through flame holder section 51 past igniter bar 58, whereupon the mixture is ignited by spark plug 59 or another effective firing means, and enters burner combustion chamber 52.

Combustion chamber 52 is preferably substantially completely cylindrical in dimension, extending from the "shoulder" 99 created by the intersection of combustion chamber 52 and adjacent flame holder section 51, and the chamber extends to the beginning of exit funnel 96, a distance 94 in dimension, at which point the combusted fuel gases enter the furnace and melt the metal charge. Chamber 52 is shown as being formed by burner tile 49, which is preferably made of silicon carbide and a thin, cylindrical sleeve 90 of predetermined uniform dimension, usually about ½ inches thick, fabricated from a hard, dense, abrasion resistant refractory substance, preferably SiC, which can withstand prolonged exposure to temperatures of the order of 2800° F. While it is preferred to use a removable SiC sleeve, in the broadest embodiment of the invention, similar results can probably be provided if the entire burner tile structure and sleeve were one-piece cast, or the like, so long as the structure conforms to the ratios and dimensions hereinafter described. The use of a sleeve allows ease of replacement of eroded or worn sections, together with permitting changes in combustion chamber dimension should the occasion arise for operating at different tonnage levels. By "predetermined dimension" of the sleeve is meant the particular substantially uniform thickness of the sleeve wall. The sleeve is axially centered within the chamber bore diameter 92, and is bonded, preferably oxide bonded, to the adjoining refractory tile 49.

It has been discovered that burner performance over a range of operating conditions is attained when burner tile 49 containing sleeve 90 has been dimensioned in a manner so as to conform to several important chamber parameters: viz., (1) the ratio of the diameter 95 of the combustion chamber ($D_S$) to the diameter 97 of the flame holder exit ($D_F$); and (2) the ratio of the "effective length" ($L_E$) to the sleeve diameter ($D_S$). In a preferred embodiment, the burner is designed to conform to the ratio of the overall tile length ($L_T$), 100, as the length measured along the chamber centerline from the entrance to the tile to an intersecting point of a plane at the exit face of the combustion chamber tile 49, to the "effective length" ($L_E$) 94 of the combustion chamber, i.e., the length of the tile lining as measured from the intersection with the flame holder section (shoulder 99) to the end of the sleeve lining at the chamber exit. The reasons for the importance of these particular parameters and ratios are not fully understood, but the following theories have been advanced, although applicants do not wish to be bound thereby.

This structural relationship of $D_S/D_F$ serves to control the degree of expansion of the fuel mixture as it exits the flame holder section and enters into the combustion chamber. This controlled expansion allows ignition to occur and the flame to seat on the shoulder formed by the flame holder section and the combustion chamber section. In prior art burners combustion reactions frequently did not proceed until about halfway into the chamber, a condition believed created by a sudden large expansion of the high speed fuel flow upon entrance into the combustion chamber. It has, surprisingly, been determined that a properly dimensioned combustion chamber vis-a-vis the igniter section ($D_S/D_F$) can provide and maintain a "stable" flame whereby the melting capacity of the burner is maintained at an optimum level, creating a flame which melts metal primarily through a convection mechanism.

The maintaining of a stable flame is particularly desirable since a long, unstable flame is characteristic of a relatively low degree of combustion of the fuel and oxygen. Such a flame permits a greater amount of copper build up within the chamber and an increase in the oxygen content of the copper to undesirable levels. A short stable flame, in contrast, is indicative of substantially complete combustion occurring within the chamber. A further consequence of incomplete combustion is the substantial variation in refractory tile temperatures and uneven refractory wear causing a shorter refractory tile life.

It has been discovered that a preferred range of combustion chamber/flame holder exit diameter ratios ($D_S/D_F$) is about 1.35 to 1.70, and, more preferably, about 1.40–1.45, e.g. 1.43.

The ratio of the effective length $L_E$ of the combustion chamber to the sleeve diameter $D_S$ of the chamber has also been found to be an important performance parameter for the burner. This is believed due to the fact that this ratio provides a suitable geometry of the combustion chamber which enhances combustion and maintains heated walls throughout this length. This ratio has been found to be dependent on the operating energy range (BTU/hr.) of the burner with, in general, increasing operating energy ranges requiring lower ratios. Thus, a range of about 1.2 to 3.7 may suitably be employed within the invention with best results being obtained when the ratio ($L_E/D_S$) ranges from about 1.85 to 3.70, and, most preferably, about 2.5–3.5, e.g., 3.0, for smaller sized burners less than about $10\times10^6$ BTU/hr., e.g., about $0.5\times10^6$ to $4\times10^6$ BTU/hr. For larger sized burners, e.g., greater than about $10\times10^6$ BTU/hr., it is preferred that the ratio ranges from about 1.2 to 1.7, e.g., about 1.3 to 1.6.

The ratio of the overall tile length ($L_T$) of the combustion chamber tile to the "effective length" $L_E$, ($L_T/L_E$) is essentially a determination of what length sleeve provides the desired result for a particular burner. Best results have been obtained when the aforementioned ratio varies from about 1.20 to 2.00, with a preferred configuration for a refractory tile about 11 inches long having a SiC sleeve extending about 6–9 inches, most preferably, about 7½ inches, giving a ratio of 1.47.

It will be appreciated by those skilled in the art that the absolute values for $D_S$, $D_F$, $L_E$ and $L_T$ will vary depending on the size (BTU/hr.) burner desired, with the proviso that the ratios noted herein be maintained. In general, the higher the BTU output of the burner, the larger the values for $D_S$, $D_F$, $L_E$ and $L_T$.

Another important system parameter is the velocity at which the combustion gases pass through the chamber. Surprisingly, the velocity of the exiting gases is about two times greater, for best results, than gas velocities occurring in burners of the prior art. This is believed due to results obtained from correlating the burner dimensions in accordance with the above ratios and the increased combustion of the fuel gases.

Thus, correlation of the burner dimensions in accordance with the invention to provide a properly dimensioned combustion chamber has helped improve flame stability over a turndown ratio of about 2½:1, thus leading to a lessening of impurity levels within the molten copper and greatly reduced combustion chamber wear.

Figure 3:
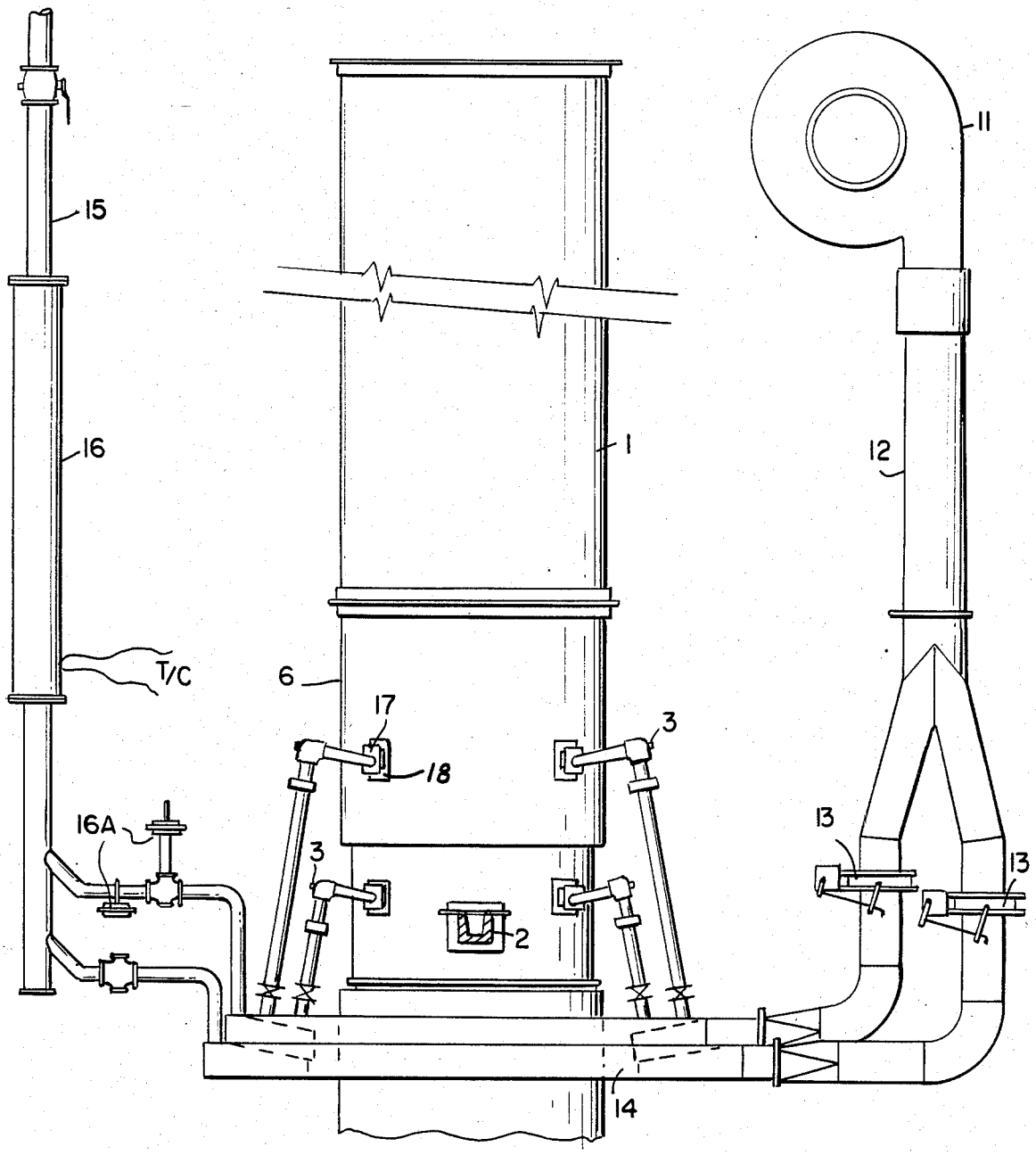
FIG. 3 describes a view of the apparatus of a shaft melting furnace.
Figure 4:
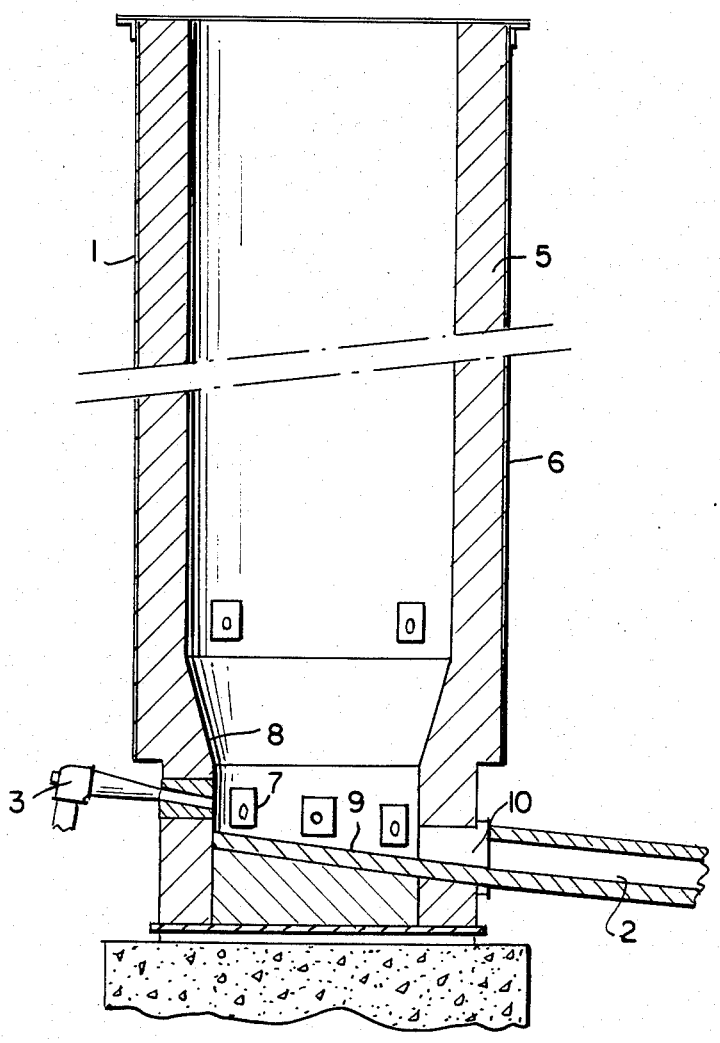
FIG. 4 is a vertical section of the furnace and a portion of the stack shown in FIG. 3, with part of the burner assemblies and the piping for supplying the fuel omitted.

FIGS. 3 and 4 describe an assembly comprised of a vertical shaft melting furnace 1, launder 2, and associated piping for supplying a plurality of burners 3 positioned in two circumferential rows with fuel and an oxygen-containing gas (air). As shown in FIG. 4, furnace 1 is provided in its side walls and bottom with a refractory lining 5 which is surrounded by shell 6, fabricated from an appropriate metal, preferably a steel which has been suitably assembled as by welding to provide a shell which is substantially gas tight. The furnace side walls are provided with a plurality of ports 7 for combustion burners 3. As shown in FIG. 4, the lower side walls 8 of the furnace are sloped inwardly, and the furnace bottom 9 is sloped towards tap hole 10, which leads into launder 2.

Viewing FIG. 3, air from blower 11 is passed at a desired positive pressure through pipe 12 to a control valve 13 feeding the air to manifolds 14, from where it is delivered at a desired positive pressure to the individual burners 3 by lagged pipes. The gaseous fuel, supplied from a suitable source, flows at a desired positive pressure through pipe 15, provided with heater 16 that is supplied with heat in any suitable manner, as for example, with a heat exchanger using either electrical heat or hot products of combustion, for preheating the fuel. The preheated fuel is subsequently passed through the lagged pipes and control valves 16A to the individual burners 3, which may also be lagged to prevent heat loss. Burners 3 are inserted into each of the side wall ports and held in position therein by bolts 17 which hold the mounting plate 18 of each burner tightly against shell 6 so as to provide a substantially gas tight mounting. Such a mounting, together with the closed construction of the burners, substantially prevents introduction of extraneous air into the furnace through the burner ports. As mentioned above, a plurality of burners are positioned in the furnace wall with each burner preferably in a predetermined spaced relationship to the other burners about the furnace.

Details of an exemplary vertical shaft melting furnace and burner may be obtained from U.S. Pat. No. 3,199,977, the contents of which are hereby incorporated by reference.

According to the invention, a preferred high velocity burner design is shown in FIG. 2 and has the following dimensions. The combustion tiles 49 for the burners are square and 9 inches on its side. Sleeve diameter $D_S$ of the combustion tile 49 of the burners is about $2\frac{1}{2}$ inches in diameter, the exit diameter of flame holding section 51, $D_F$, is about 1.75 inches, and $D_S/D_F$ is about 1.43. The burner is provided with an electrically actuated spark plug 59 to ignite the unit stream and is provided with an igniter bar 58 to assist in maintaining combustion of the unit stream in the combustion chamber 52. The effective length $L_E$, measure from the end of the flame holding section 51 to the end of the combustion tile 49 is about $7\frac{1}{2}$ inches. The tile length, $L_T$, is about 11 inches, making $L_T/L_E=1.47$. The ratio of the effective length, $L_E$, to the exit sleeve diameter $D_S$, $L_E/D_S=3.00$. This burner provides a stable flame over a turn-down ratio of about 2.5:1 in a vertical melting furnace of the type described in U.S. Pat. No. 3,199,977 having a design melting capacity of about 20 STPH.

Referring to FIG. 2, a high capacity burner providing in excess of $10\times10^6$ BTU/hr. according to the invention has a sleeve diameter $D_S$ of about $10\frac{1}{4}$ inches, an exit diameter $D_F$ of about $7\frac{1}{2}$ inches, an effective length $L_E$ of about 16 inches and a tile length $L_T$ of about 23 3/16 inches. The ratio of $D_S/D_F$ is 1.37, $L_E/D_S$ is 1.56 and $L_T/L_E$ is 1.45. This burner provides a stable flame over a turn-down ratio of about 2.5:1.

We claim:

1. An improved gas burner providing about a $2\frac{1}{2}$:1 turndown capacity while maintaining a stable flame with even and complete combustion over this range comprising a mixing section for uniting a stream of fuel and a stream of oxygen containing gas, a flame holder section having an exit diameter, $D_F$, for igniting the mixture of fuel and oxygen and an adjacent combustion chamber to retain the combustion and to enhance combustion, the combustion chamber being formed by a refractory burner tile and being of substantially cylindrical shape and having a diameter, $D_S$, an effective length, $L_E$, and an overall burner tile length, $L_T$, the improvement comprising:

correlating the burner dimensions whereby $D_S/D_F$ is between about 1.35 to 1.70 and $L_E/D_S$ is between about 1.2 to 3.7.

2. The burner of claim 1 wherein the combustion chamber burner dimensions are correlated whereby $L_T/L_E$ is between about 1.2 to 2.0.

3. The burner of claim 1 wherein $D_S/D_F$ is between about 1.40 to 1.45.

4. The burner of claim 1 wherein the combustion chamber is axially positioned along a common centerline with the adjacent flame holder section.

5. The burner of claim 1 wherein the amount of heat generated is up to about 50 million BTU/hr.

6. The burner of claim 1 wherein the amount of heat generated is between about $0.7\times10^6$ to $1.8\times10^6$ BTU/hr.

7. The burner of claim 1 wherein $L_E/D_S$ is between about 1.85 to 3.7.

8. The burner of claim 7 wherein the amount of heat generated is less than about $10\times10^6$ BTU/hr.

9. The burner of claim 1 wherein $L_E/D_S$ is between about 1.2 to 1.7.

10. The burner of claim 9 wherein the amount of heat generated is greater than about $10\times10^6$ BTU/hr.

* * * * *